US007363931B2

(12) United States Patent
Weaver

(10) Patent No.: US 7,363,931 B2
(45) Date of Patent: Apr. 29, 2008

(54) WALKER WITH LIFTING ARMS

(76) Inventor: Craig Weaver, 1713 Vandever Rd., Crossville, TN (US) 38572

( * ) Notice: Subject to any disclaimer, the term of this patent is extended or adjusted under 35 U.S.C. 154(b) by 0 days.

(21) Appl. No.: 11/201,737

(22) Filed: Aug. 11, 2005

(65) Prior Publication Data

US 2006/0096626 A1 May 11, 2006

Related U.S. Application Data

(60) Provisional application No. 60/625,085, filed on Nov. 5, 2004.

(51) Int. Cl.
*A61H 3/00* (2006.01)
*A61G 7/14* (2006.01)

(52) U.S. Cl. ..... 135/67; 135/66; 5/86.1; 5/83.1; 280/87.021

(58) Field of Classification Search ..... 135/65–67, 135/75; 403/109.1–109.3, 109.5, 109.7; 5/81.1 R, 83.1, 86.1; 280/87.021, 87.01
See application file for complete search history.

(56) References Cited

U.S. PATENT DOCUMENTS 2,374,182 A 4/1945 Duke
2,759,525 A 8/1956 Ries
2,785,731 A 3/1957 Welsh
2,855,024 A 10/1958 Robb
3,041,636 A 7/1962 Twedt
3,432,162 A 3/1969 Flemming
3,455,313 A * 7/1969 King ..... 135/67
3,529,819 A 9/1970 Blank
4,094,331 A * 6/1978 Rozsa ..... 135/67
4,135,535 A 1/1979 Thomas
4,212,493 A 7/1980 Ledesky
4,251,105 A 2/1981 Barker
4,411,283 A 10/1983 Lucarelli
4,474,202 A * 10/1984 Blechner ..... 135/67
4,700,730 A 10/1987 Samuelson et al.
4,729,395 A 3/1988 Adamson
4,748,994 A * 6/1988 Schultz et al. ..... 135/67
4,777,973 A 10/1988 Nakajima
4,941,496 A 7/1990 Berning
4,993,446 A 2/1991 Yarbrough
5,189,741 A 3/1993 Beardmore
5,224,717 A * 7/1993 Lowen ..... 280/1.5
5,305,773 A * 4/1994 Browning ..... 135/67
5,320,122 A 6/1994 Jacobson, II et al.
5,347,666 A 9/1994 Kippes
5,364,120 A * 11/1994 Shimansky ..... 280/650
5,449,013 A * 9/1995 Landers ..... 135/67
5,499,645 A * 3/1996 Baliga ..... 135/67
5,649,558 A * 7/1997 Richard ..... 135/67

(Continued)

FOREIGN PATENT DOCUMENTS

FR 2625899 A2 * 7/1989

(Continued)

*Primary Examiner*—Winnie Yip
(74) *Attorney, Agent, or Firm*—Sutherland Asbill & Brennan, LLP

(57) ABSTRACT

A system for assisting a seated person to stand that may include a walker and a lifting arm attached to the walker that extends in an approximate vertical direction from the walker. The walker may include two front legs and two rear legs, and the lifting arm may extend telescopically from one of the front legs.

20 Claims, 10 Drawing Sheets

U.S. PATENT DOCUMENTS 5,785,070 A * 7/1998 Block et al. ..... 135/67
5,853,015 A 12/1998 Evans
5,950,258 A 9/1999 Deyne et al.
5,954,075 A * 9/1999 Gilmour ..... 135/67
5,983,421 A * 11/1999 Walser ..... 135/66
5,983,911 A * 11/1999 Steele ..... 135/66
6,044,507 A 4/2000 Smith
6,082,384 A * 7/2000 Cheng ..... 135/67
6,099,002 A * 8/2000 Uchiyama ..... 135/67
6,148,448 A * 11/2000 Urso ..... 4/254
6,213,672 B1 * 4/2001 Varga ..... 403/109.2
6,244,285 B1 * 6/2001 Gamache ..... 135/67
6,276,007 B1 8/2001 Brown
6,503,176 B2 1/2003 Kuntz
6,615,432 B1 9/2003 Blaylock
6,705,336 B2 * 3/2004 Goligorski ..... 135/67
6,733,018 B2 * 5/2004 Razon ..... 280/87.021
D494,109 S * 8/2004 Karasin et al. ..... D12/130
6,851,751 B1 2/2005 Romero et al.
6,961,967 B1 * 11/2005 Brown ..... 5/81.1 R
2003/0111100 A1 6/2003 Bell et al.

FOREIGN PATENT DOCUMENTS

GB 1373593 * 11/1974

* cited by examiner

WALKER WITH LIFTING ARMS

RELATED APPLICATIONS

The present application is a Non-provisional of U.S. patent application Ser. No. 60/625,085, filed Nov. 5, 2004, which is hereby incorporated by reference as if set forth fully herein.

TECHNICAL FIELD

This present invention relates generally to methods and systems for assisting a seated person to a standing position.

BACKGROUND OF THE INVENTION

Many persons require assistance to stand from a seated position. Generally, these persons have a disability, are infirm because of age, are recovering from illness or surgical procedure, or have some other type of condition that limits their ambulatory capabilities. Certain methods and systems for assisting persons to stand from a seated person are known and available to such persons.

Of course, the most simple of these known methods likely is to physically lift the person without the aid of any devices. This method, though, has many shortcomings. Many persons who require standing assistance may not have available to them a person who is physically capable of lifting them from a seated position. Even where such a person is available, physical lifting often causes injury to the lifter because the lifter is required to lift too much weight or lift from an awkward position. Further, the infirm person receiving the lift also is at risk, as such lifting often causes skin tears and creates unstable situations that result in falls.

More complicated methods and systems also have been described. For example, a full body sling lift has been available for many years. Generally, these type of lifts are used for persons who have no weight bearing ability in their legs. While such devices may be useful in certain applications, they are difficult and time consuming to use. Further, these devices generally are not appropriate for persons that have some ambulatory capabilities and only require assistance to stand.

Sit/stand lifts also have been available in the market place for many years. A person who might benefit from this type of lift generally has upper arm strength and minimal weight bearing ability. The purpose of the sit/stand lift is to transfer a person from a sitting position to another sitting position or to the bed side. These types of lifts, however, are cumbersome and time consuming to use. As a result, a caregiver is tempted to manually help an infirm person to a standing position, which, as described above, may cause injury to the lifter or the person being lifted. A sit/stand lift also does not adequately meet the needs of the persons who only require help standing so that they may use a walker. Further, sit/stand lifts are often expensive, bulky, difficult to store, hard to maneuver in small areas, and difficult and time consuming to use.

Another option available to caregivers is a gate belt. Generally, a gate belt may be used to help a person attain a standing position so that they may use a walker or pivot to another sitting position. While gate belts may be effective for certain applications, they still tend to create an unstable situation during the lifting for the caregiver and person being lifted that leads to frequent falls and injuries. Further, the amount of weight the caregiver is required to lift is often unsafe and beyond Occupational Safety and Health Administration ("OSHA") guidelines. The risk of injury is further heightened due to the twisting and ergonomically unsafe positioning that occurs during a gate belt lift.

As a result, there is a long-felt need for a better method to help infirm and other persons stand from a seated position.

SUMMARY OF THE INVENTION

The present application thus may describe a system for assisting a seated person to stand that may include a walker and a lifting arm attached to the walker that extends in an approximate vertical direction from the walker. The walker may include two front legs and two rear legs and the lifting arm may extend telescopically from one of the front legs. A footpad may be attached to the bottom of one of the front legs. The footpad may be attached by a hinged connector.

The lifting arm may be adjustable between two or more positions of extension. The two or more positions of extension may include an extended position wherein the lifting arm is fully extended above the one front leg. The two or more positions of extension further may include a non-extended position where the majority of the length of the lifting arm is contained inside one of the front legs. The system further may include openings in the lifting arm that engage a pin connected to the front legs. Each opening may correspond to one of the two or more positions of extension such that when the lifting arm slides telescopically between the two or more positions of extension, the corresponding opening is engaged by the pin. The system further may include a guide channel in the lifting arm that maintains alignment between the openings and the pin when the lifting arm is being slid between the two or more positions of extension.

In some embodiments, the lifting arm may include a vertical member that extends telescopically in an approximate vertical direction from each of the front legs. A horizontal connector may connect the two vertical members. The lifting arm of this embodiment similarly may be adjustable between two or more positions of extension. An actuator may disengage a pin of each front leg from respective openings in the vertical members to allow the vertical members to slide telescopically. The actuator may located on a cross support of the walker.

In some embodiments, one or more connectors may connect the vertical members of the lifting arm to the front legs. The connectors may connect the vertical members to the front legs such that a lower portion of each of the vertical members resides adjacent to one of the front legs and each of the vertical members is orientated in a direction that is substantially parallel to one of the front legs. A lifting arm that is connected in this manner may be adjustable between two or more positions of extension. The connector may include two openings (an arm opening that is sized to fit around one of the vertical members of the lifting arm and a leg opening that is sized to fit around one of the front legs), means for laterally adjusting the arm opening in relation to the leg opening, and means for tightening the arm opening and the leg opening to secure the vertical member in a desired position relative to the front leg.

In other embodiments, the systems may include a hinged connector for connecting the lifting arm to one or more of the front legs. The hinged connector may include a closed position and an open position. In the closed position, the lifting arm may reside substantially adjacent and substantially parallel to at least one of the front legs. When the hinged connector is in the open position the lifting arm may extend above the front legs in an approximate vertical direction. The bottom of each of the front legs may include a shoe. The bottom surface of the shoe may be arcuate in shape.

The present invention further may include a device for attaching to a walker for assisting a sitting person to stand. The device may include a lifting arm that includes two vertical members and a horizontal connector that connects the two vertical members and one or more connectors for connecting the vertical members to the front legs of the walker. The connectors may connect the vertical members to the front legs such that a lower portion of each of the vertical members resides adjacent to one of the front legs and each of the vertical members is orientated in a direction that is substantially parallel to one of the front legs. The connectors may be similar to those described above. The lifting arm may be adjustable between two or more positions of extension.

The present invention further may include a method for assisting a seated person to stand using a walker with a lifting arm attached to the walker that extends in an approximate vertical direction above the walker. The method may include having the seated person hold onto the walker or the lifting arm and having a helper pull the lifting arm in a direction away from the seated person. The lifting arm may extend telescopically from one of the front legs of the walker. The lifting arm may be adjustable between two or more positions of extension. The method may further include having the helper check the location of the lifting arm and, if the lifting arm is not in an extended position, having the helper adjust the lifting arm to the extended position. The method may further include having the helper adjust the lifting arm to a non-extended position once the seated person is standing.

The lifting arm used in the method may include a vertical member that extends telescopically in an approximate vertical direction from each of the front legs. A horizontal connector may connect the two vertical members. The lifting arm may be adjustable between two or more positions of extension. The vertical members may be connected to the front legs by one or more connectors. The walker further may include a footpad attached to the bottom of one of the front legs. The method further may include having the seated person press one of his feet on the footpad as the helper pulls the lifting arm in the direction away from the seated person. In other embodiments, the method may include having the helper press one of his feet on the footpad as the helper pulls the lifting arm in the direction away from the seated person.

These and other features of the present invention will become apparent upon review of the following detailed description of the preferred embodiments when taken in conjunction with the drawings and the appended claims.

DETAILED DESCRIPTION OF EXEMPLARY EMBODIMENTS

Figure 1A:
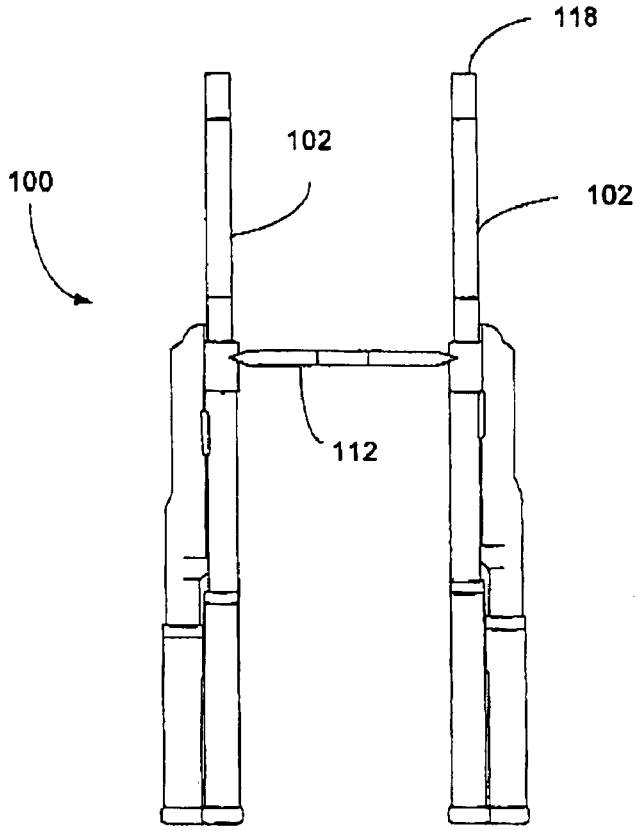
FIG. 1(*a*)-1(*c*) demonstrate several views of an embodiment in accordance with the present invention.
Figure 1B:
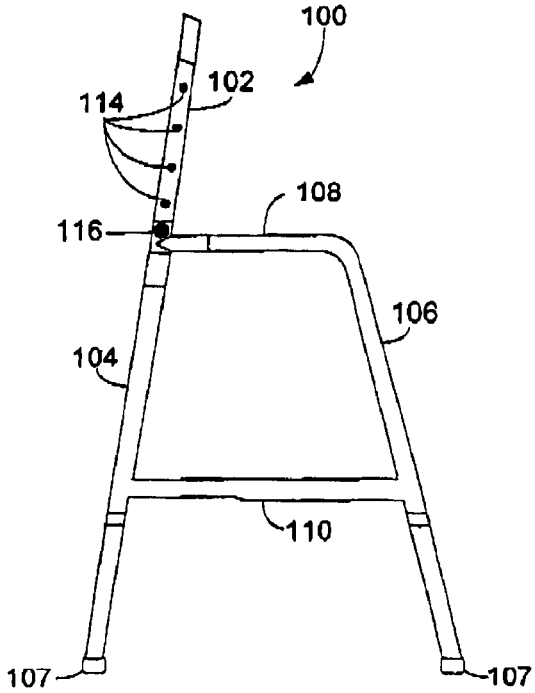
Figure 1C:
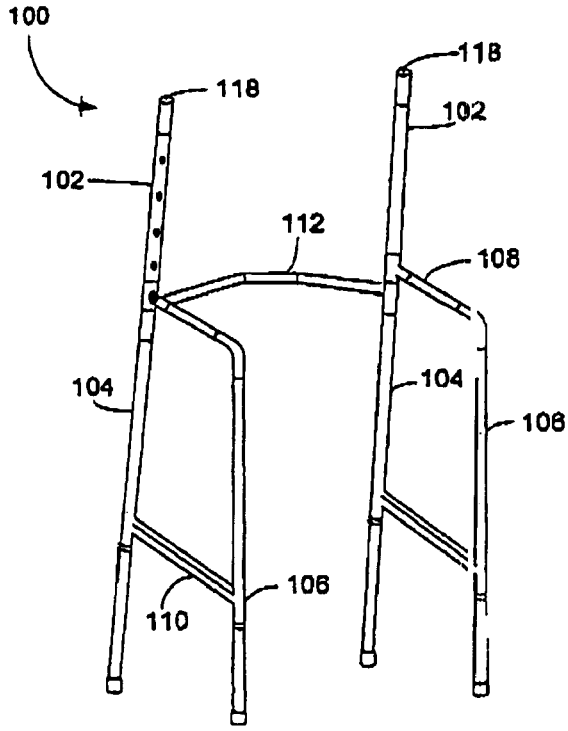

Referring now to the figures, where the various numbers represent like parts throughout the several views, FIG. 1 demonstrates a walker device according to an embodiment of the present invention, including a walker 100 with one or more lifting arms 102. The walker 100 may be any type of walker device known in the art, which generally are used by persons that need support, assistance or stabilization to walk. These devices may be used by the elderly, persons recovering from sickness or surgical procedures, persons with balance problems, or other conditions. Generally, the walker 100 may include a pair of front legs 104 and a pair of back legs 106. Each leg 104/106 may be fitted with a shoe 107, which may be made from rubber or other tacky material and may aid in preventing slips. The front leg 104 and the back leg 106 on each side of the walker 100 may be connected by one or more support members, which, as shown in FIG. 1, may include a top support 108 and a bottom support 110. The top support often functions as a handle when the walker 100 is in use. The two front legs 104 of the walker 100 may be connected by support members, which, as shown in FIG. 1, may include a cross support 112. Those of ordinary skill in the art will recognize that other configurations for the walker 100 are possible and that the description of the walker 100 herein is exemplary only.

The various members of the walker 100 may be formed of 1 inch diameter, 0.0125 inch wall thickness aluminum tubing, which is known in the art and common for such applications. Other equivalent or similar materials may be used and other sizes may be possible. The members may be attached pursuant to methods known in the art.

Figure 2A:
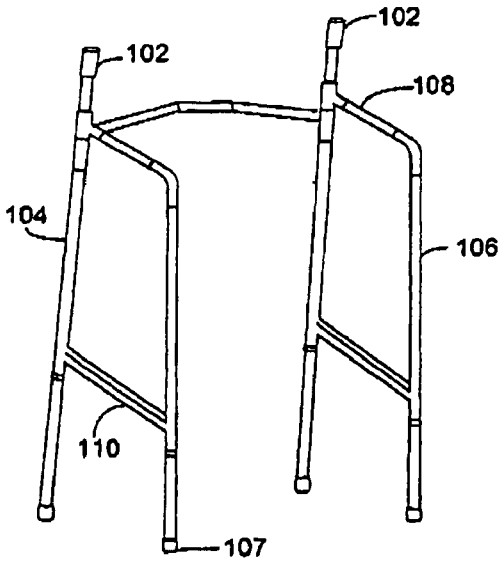
FIG. 2(*a*)-2(*c*) demonstrate several additional views of the embodiment of FIG. 1.
Figure 2B:
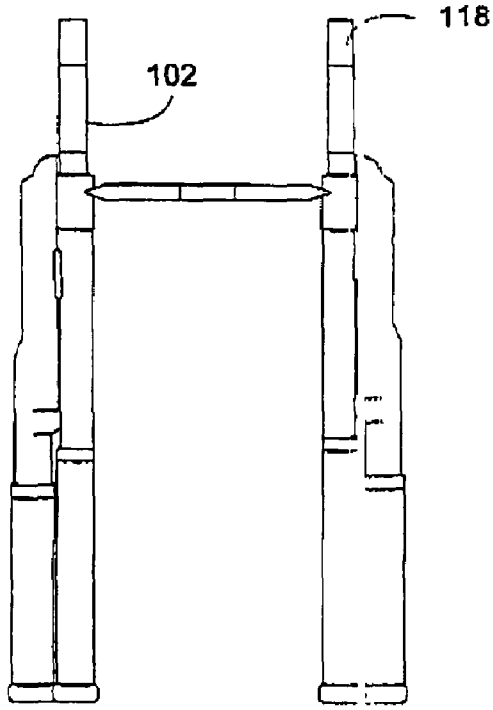
Figure 2C:
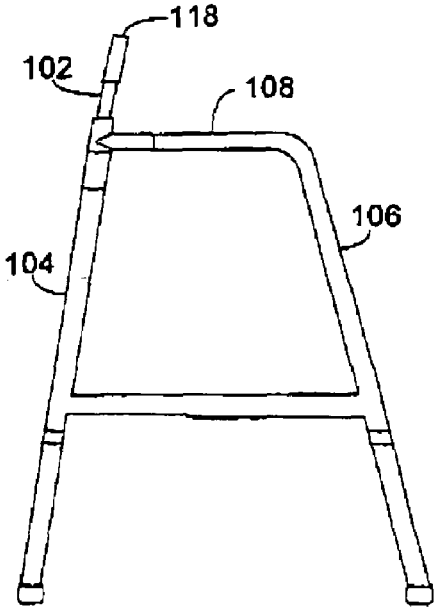

The lifting arms 102 may also be formed of tubular aluminum or other similar materials. The diameter of the lifting arms 102 may be sized such that the lifting arms 102 may be telescopically mounted into one or more of the legs 104/106 of the walker 100. As shown in FIG. 1, the lifting arms 102 may be mounted in the front legs 104 of the walker 100, though, in other embodiments of the walker 100, it may be beneficial to mount the lifting arms 102 in the rear legs 106. The telescopic mounting of the lifting arms 102 may allow the lifting arms 102 to extend from the front legs 104 in an upward or approximate vertical direction. Further, the telescopic mounting of the lifting arms 102 may allow for the efficient adjustment of the height of the lifting arms 102, as the lifting arms 102 may be slid upward to an extended position (as shown in FIG. 1) or downward to a non-extended position (as shown in FIG. 2) or positions in between, as desired.

With regard to the embodiment illustrated in FIG. 1, the lifting arms 102 may engage the front legs 104 such that, when desired, the lifting arm 102 becomes fixed at certain positions of extension. As stated, the positions of extension may include an extended position, non-extended position, and/or other intermediate extended positions. This adjustable function may be accomplished by using any of several common mechanical systems known in the art. One such system may include a series of openings 114 that are engaged by a pin 116. In some embodiments, the openings 114 may be spaced along the lifting arms 102 such that their placement coincides with the desired positions of extension for the lifting arm 102. The pin 116 may be located in the upper portion of the front leg 104. In a closed state, the pin 116 may engage the opening 114 of the lifting arm 102, thus securing the lifting arm 102 in a fixed position. In an opened state, the pin 116 may disengage from the opening 114 and allow the lifting arm 102 to telescopically slide to other positions of extension.

As stated, one of the openings 114 may be located on the lifting arm 102 such that it coincides with an extended position. In the extended position, the lifting arm 102 may fully extend such that much of the length of the lifting arm 102 extends in an approximate vertical direction above the front leg 104. In this position, as shown in FIG. 1, the lifting arm 102 may extended above the top of the front leg 104 a length of about 12 to 36 inches. Another opening 114 may be located on the lifting arm 102 such that it coincides with a non-extended position. In this position, much of the length of the lifting arm 102 may be contained within the front leg 104, as shown in FIG. 2. The lifting arm 102 may include a gripping handle 118 at its top end. The gripping handle 118 may be approximately 4-5 inches in length and may made of foam, rubber or other similar materials that are commonly used for such applications. In the non-extended position, only the gripping handle 118 and/or a small portion of the lifting arm 102 may extend above the top of the front leg 104. In other embodiments, though, the complete lifting arm 102, including the gripping handle, may be contained in the front legs in the non-extended position. In addition, in other embodiments, the lifting arm 102 may be provided in a fixed position (i.e., non-adjustable position) relative to the walker 100.

Figure 3:
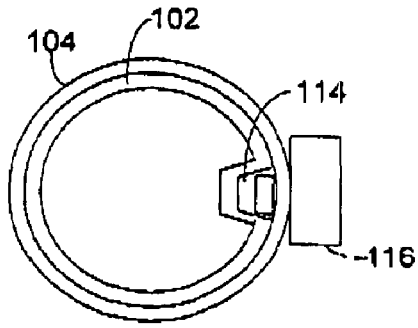
FIG. 3 demonstrates an embodiment of a pin/opening device that may be used in certain embodiments in accordance with the present invention.

FIG. 3 demonstrates an embodiment of the pin 116/opening 114 assembly that may be used with certain embodiments of the current invention to make the lifting arm 102 adjustable. To adjust the lifting arm 102, the pin 116 may be pulled outward such that it disengages the opening 114, which is referred to herein as the opened position. When the pin 116 is disengaged, the lifting arm 102 may be telescopically slid upward or downward, as appropriate, to a desired position of extension where an opening 114 that places the lifting arm at the desired position may be encountered. The pin 116 may be biased by a spring or other similar device such that it "clicks" into place when it encounters another opening 114. Further, an alignment channel (not shown) may be used to engage the pin 116 while adjustment is being performed such that the openings 114 remained aligned with the pin 116 location. In such an embodiment, the pin 116 may disengage from the opening 114 of the lifting arm 102 while remaining engaged with an alignment channel formed in the surface of the lifting arm 102. The engagement of the pin 116 in the alignment channel would guide the lifting arm 102 during adjustment so that the pin 116 and the openings 114 remained longitudinally aligned. Those of ordinary skill will recognize that other methods and systems are available for adjustably connecting the lifting arms 102 to the front legs 104. The pin 116/opening 114 assembly is provided herein as an example only. Other known methods, such as a releasable clamp, removable bolt or other suitable method may be used.

Figure 4B:
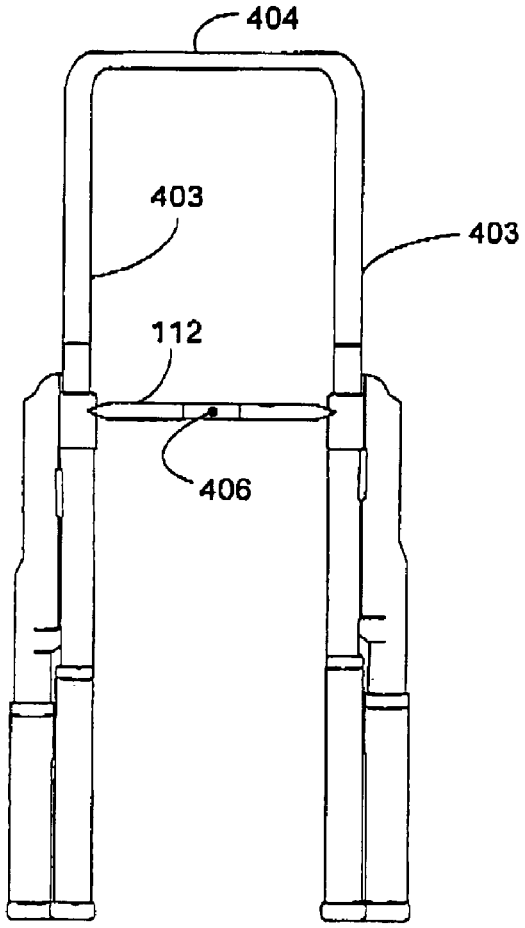
FIG. 4(*a*)-4(*c*) demonstrate several views of an alternative embodiment in accordance with the present invention.
Figure 4A:
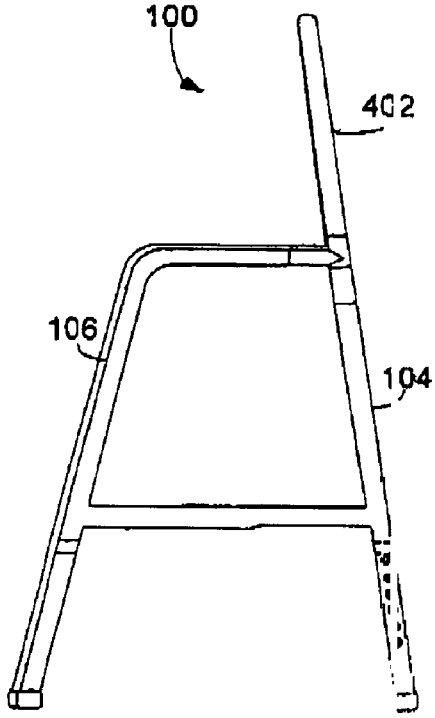
Figure 4C:
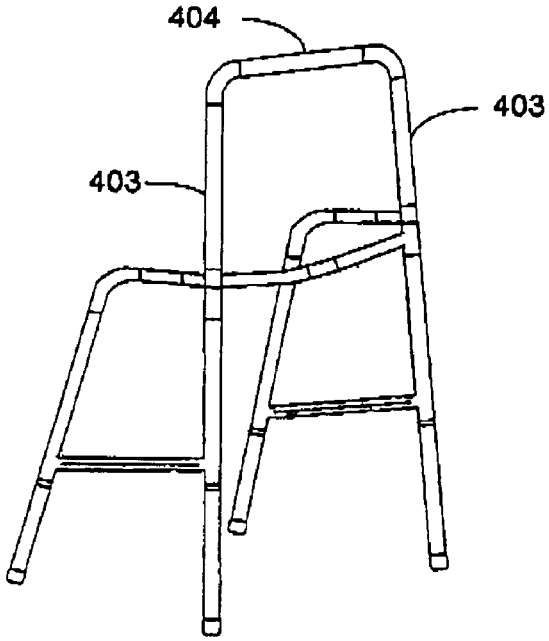

FIG. 4 demonstrates another embodiment in accordance with the present invention, including the walker 100 with a lifting arm 402. Generally, the walker 100 may be as it is described above; though, those of ordinary skill will appreciate that other types of walkers may be used with the lifting arm 402 embodiment. As shown in FIG. 4, the lifting arm 402 may be mounted in the front legs 104 of the walker 100, though, in other walker embodiments, it may be beneficial to mount the lifting arm 402 in the rear legs 106. Lifting arm 402 may include a vertical member 403 that extends in an approximate vertical direction from each of the front legs 104. The two vertical members 403 may then be connected by a horizontal connector 404.

Each of the vertical members 403 of the lifting arm 402 may extend telescopically out of the front legs 104, similar to the manner in which it was explained above that the lifting arms 102 extended out of the front legs 104. A similar pin 116/opening 114 assembly may be used to allow the lifting arm 402 to be adjusted and fixed at certain positions of extension. As shown in FIG. 4, the lifting arm 402 may be adjusted to an extended position, in which the horizontal connector 404 resides approximately 12 to 36 inches above the top of the front legs 104. In the extended position, the lifting arm 102 may fully extend such that much of the length of the vertical members 403 extends above the front legs 104. In a non-extended position (not shown), much of the length of the vertical members 403 may reside inside the front legs 104. In this position of extension, the horizontal connector 404 may reside in close proximity to the cross support 112 of the walker 100.

The one piece construction of the lifting arm 402 may allow for more efficient and convenient adjustment. For example, in certain embodiments, a single adjustment actuator 406, may disengage both pins 116 associated with each of the vertical members 403 with a single action. The single adjustment actuator may be located on the cross support 112. A connection from the single adjustment actuator 406 may be made through the tubular cross support 112 to the location of the pins 116, which may be located at the intersection of the front legs 104 and the cross support 112. The single adjustment actuator 406 and the connections made through the cross support 112 to the pins 116 may be made with systems and devices known in the art. With the single adjustment actuator 406, the lifting arm 402 may be released from a fixed position, raised in a single action, i.e., one hand may depress the single adjustment actuator 406, which disengages both pins 116 of the vertical members 403 and, in turn, allows the lifting arm 402 to slide telescopically within the front legs 104, while the other hand raises or lowers the lifting arm 402 to the desired position of extension. In other embodiments, an adjustment actuator may be located on each of the front legs 104 that separately disengages the pin 116 associated with each vertical member 403. In still other embodiments, a single adjustment actuator may be located on other components of the walker 100, such as on one of the front legs 104 or one of the top supports 108.

Figure 5:
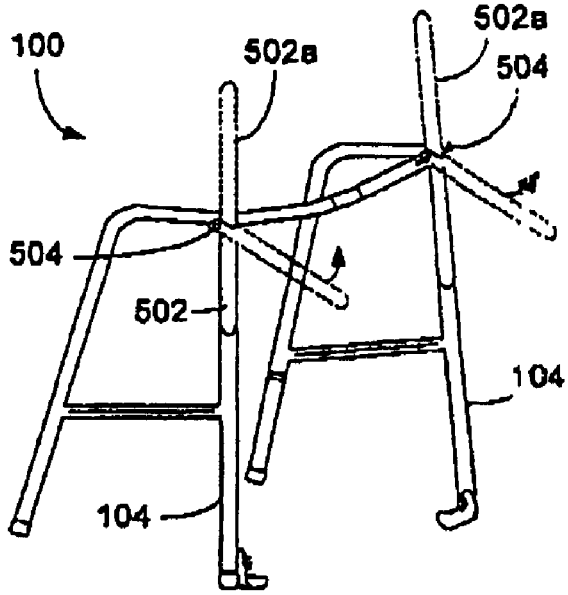
FIG. 5 demonstrates a view of an embodiment in accordance with the present invention.

FIG. 5 demonstrates another embodiment in accordance with the present invention, including the walker 100 with lifting arm 502. In this embodiment, the lifting arm 502 may be hinged to a position on the front leg 104 of the walker 100. While not in use, the lifting arm 502 may reside in a "down" position such that it is adjacent to the front leg 104. The lifting arm 502 may be concave in shape so that it may rest closely to the rounded surface of the front leg 104. The lifting arm 502 may be rotated upward (as indicated by the arrows) about a pivot point 504. The pivot point 504 generally may be located between the midpoint and top of the front leg 104. The hinged connection may be constructed by methods and devices known in the art, such as pinning the lifting arm 502 to the front legs 104 or other similar methods. The lifting arm 502 may rotated approximately 180° about the pivot point 504 to an "up" position, which is indicated by dashed lines as lifting arm 502*a*. In the "up" position the lifting arm 502*a* may lock into position so that it may be used. The lifting arm 502 then may unlock so that it may be rotated back to the "down" position when not in use. The locking/unlocking function may be accomplish per methods known in the art.

Figure 6:
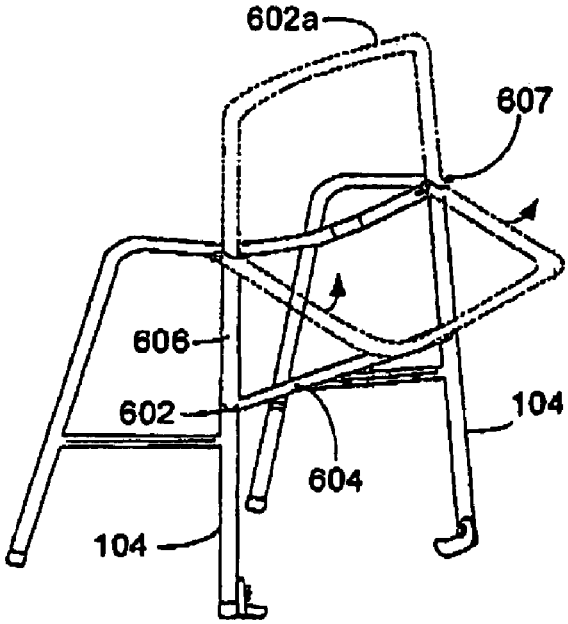
FIG. 6 demonstrates a view of an embodiment in accordance with the present invention.

FIG. 6 demonstrates another embodiment in accordance with the present invention, including the walker 100 with a lifting arm 602. In this embodiment, the lifting arm 602 may include a horizontal connector 604 that connects two vertical members 606. Similar to the embodiment discussed above, the vertical members 606 of the lifting arm 602 may be hinged to a position on the front legs 104 of the walker 100. While not in use, the lifting arm 602 may reside in a "down" position such that the vertical members 606 are adjacent to the front leg 104. The lifting arm 602 may be rotated upward (as indicated by the arrows) about a pivot point 607. The pivot point 607 generally may be located between the midpoint and top of each of the front legs 104. The hinged connection may be constructed by methods and devices known in the art, such as pinning the vertical members 606 to the front legs 104 or other similar methods. The lifting arm 602 may rotated approximately 180° to an "up" position, which is indicated by dashed lines as lifting arm 602*a*. In the "up" position the lifting arm 602*a* may lock into position so that it may be used. The lifting arm 602 then may unlock so that it may be rotated back to the "down" position when not in use. The locking/unlocking function may be accomplish per methods known in the art.

Figure 7A:
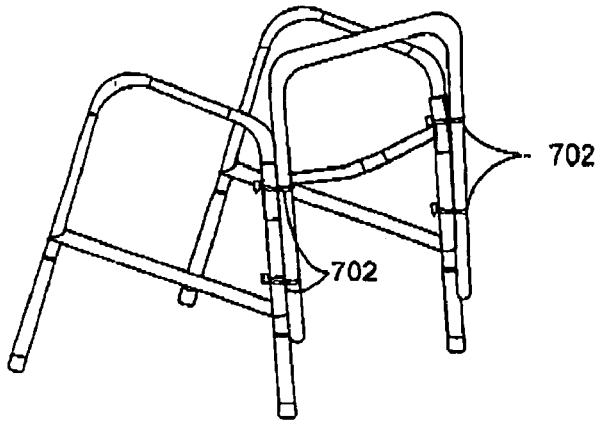
FIG. 7(*a*)-7(*c*) demonstrate several views of an alternative embodiment in accordance with the present invention.
Figure 7B:
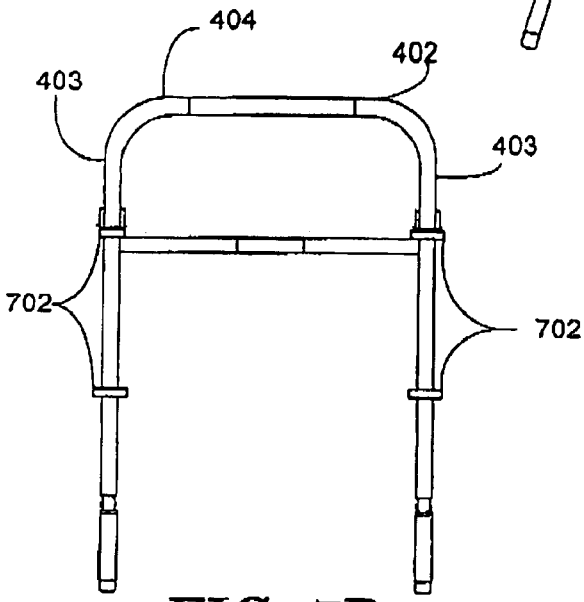
Figure 7C:
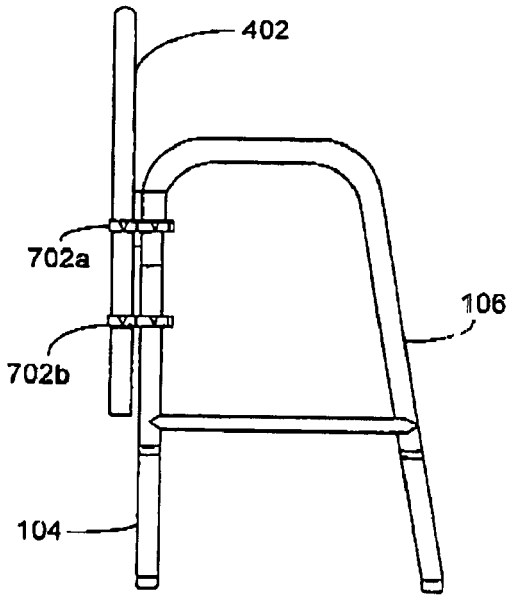

As demonstrated in FIG. 7, other embodiments of the current invention include attaching the lifting arm 402 onto each of the front legs 104 with one or more connectors 702. (Note that the other lifting arm embodiments described herein also may be attached to the walker 100 with the connectors 702, and the use in FIG. 7 of the lifting arm 402 is exemplary only.) In such embodiments, the lifting arm 402 no longer extends telescopically from the front leg(s) 104, but attaches to the outside thereof. The use of connectors 702 may allow for the efficient attachment of the lifting arm 402 to existing walkers. The connectors 702 may be any clamp or connector known in the art that may be used to attach two members side by side in the manner shown. For stability purposes, two or more connectors 702 may be used for each front leg 104/vertical member 403 pairing, such as an upper connector 702*a* and lower connector 702*b*, though those of ordinary skill in the art will recognize that different sized connectors may be used that would necessitate the use of only one connector 502 for each pairing.

Figure 8B:
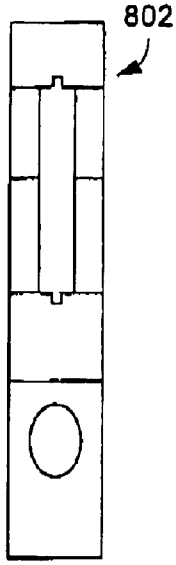
FIG. 8(*a*)-8(*c*) demonstrate several views of an embodiment of a connector device that may be used in certain embodiments of in accordance with the present invention.
Figure 8A:
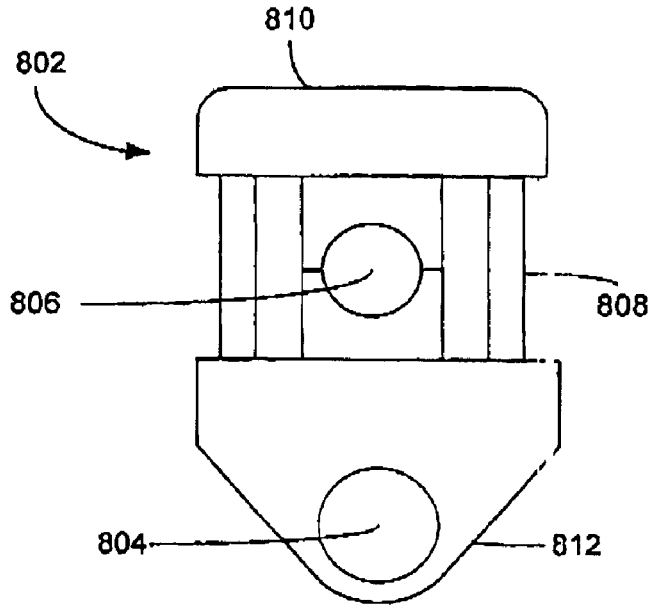
Figure 8C:
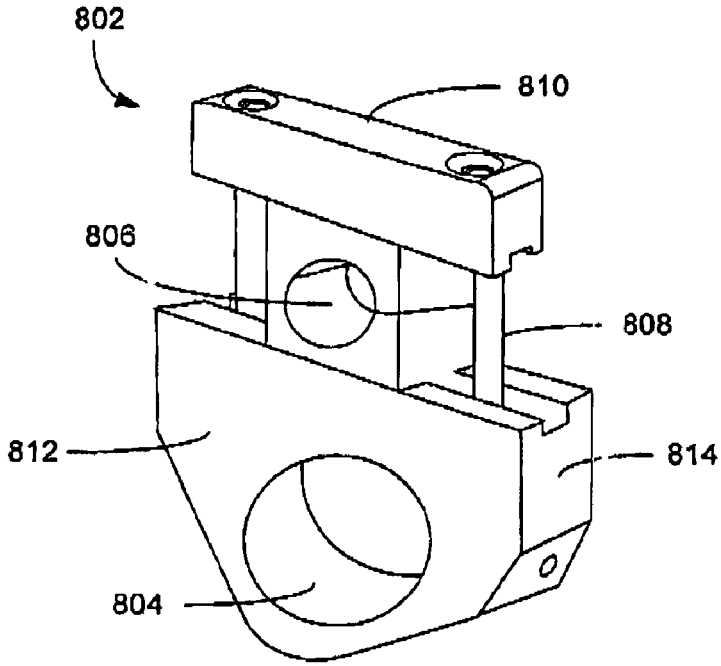

FIG. 8 demonstrates an embodiment of a connector that may be used in accordance with the present invention, a connector 802. The connector 802 may include a leg opening 804 that may be sized to fit around the front legs of a walker. The connector may include an arm opening 806 that may be sized to fit around the vertical member of a lifting arm. After the connector 802 is fitted in place (i.e., with the leg opening around the front leg and the arm opening around the vertical member), then two bolts 808 may be fed through an upper flange 810 positioned around the arm opening 806 and threaded into openings in a lower flange 812, which may be formed around the leg opening 804. The upper flange 810 may adjust laterally in relation to the lower flange 812 along channel 814. In this manner, the connector 802 may adjust to take into account the angle offset that may be present between the vertical member of the lifting arm and the front leg of some walkers. The bolts 808 may be tightened such that the connector 802 secures the lifting arm to the front leg. The lifting arm may be adjusted in its position relative to the front leg by loosening the bolts 808 and sliding the lifting arm relative to the front leg. In this manner, the lifting arm may be placed in an extended and non-extended position as desired. Those of ordinary skill in the art will recognize that other connectors may be used for this function and that the description herein is exemplary only.

Other means of connecting the lifting arm to walker 100 are possible. For example, in one embodiment (not shown), the lifting arm may be attached to a hinged connector that is clamped to the top of one of the front legs 104. Similar to the embodiment shown in FIG. 6, the hinged connector may be configured such that, when it is in a "down" position, the vertical members of the lifting arm may be in a position parallel and adjacent to the front leg. In this position, the lifting arm may be stored in a position that is not obtrusive to the functioning of the walker. The hinged connector further may be configured to rotate approximately 180° to an "up" position. When the hinge is in the "up" position, the lifting arm may extend in a approximate vertical direction above the front leg. Those of ordinary skill in the art will further recognize that other systems and devices may be used to attach the adjustable or fixed lifting arm of the present invention to an existing walker and that the embodiments that have been described herein are exemplary only.

Figure 9:
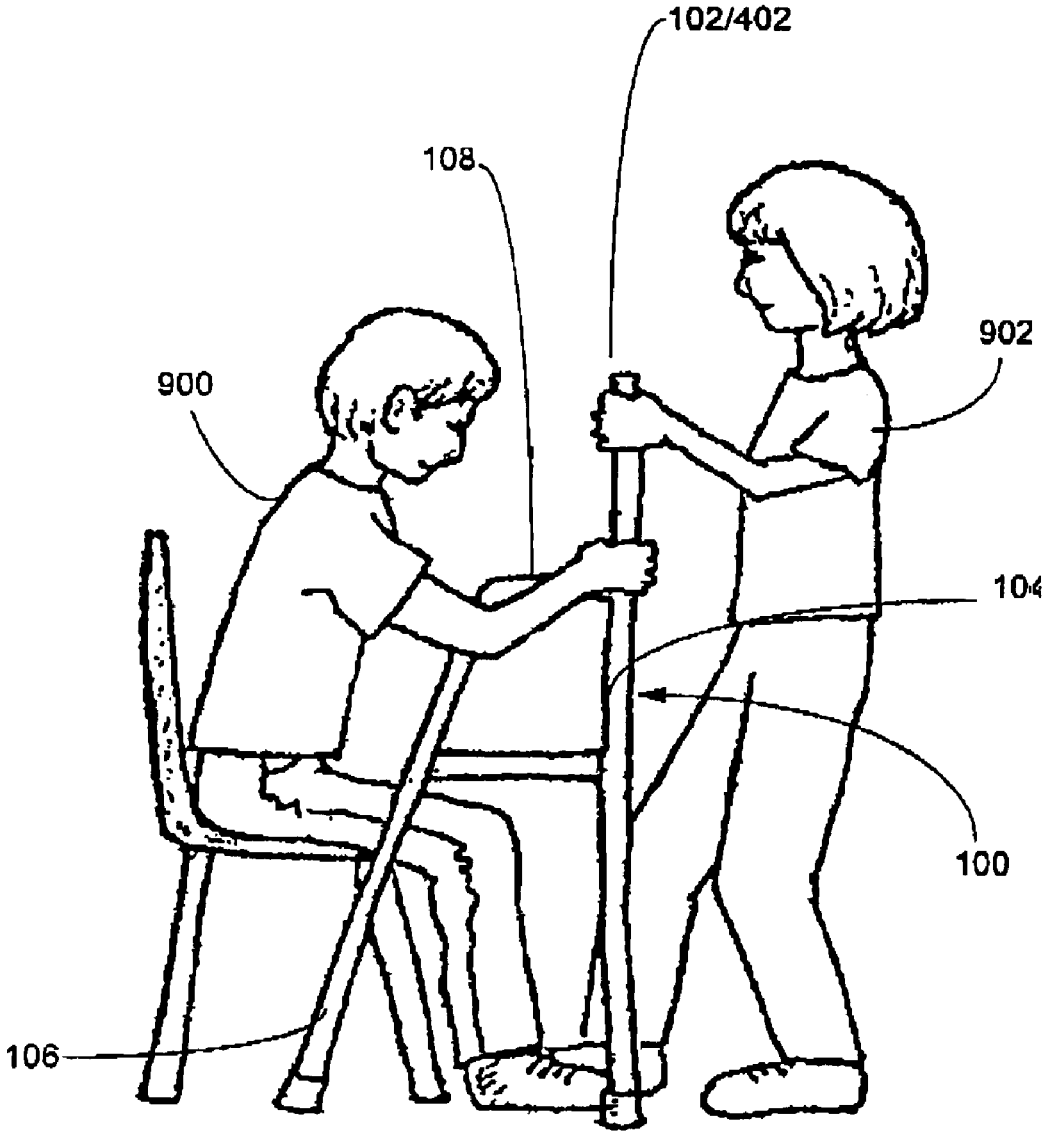
FIG. 9 demonstrates a view of an embodiment in accordance with the present invention in use.
Figure 10:
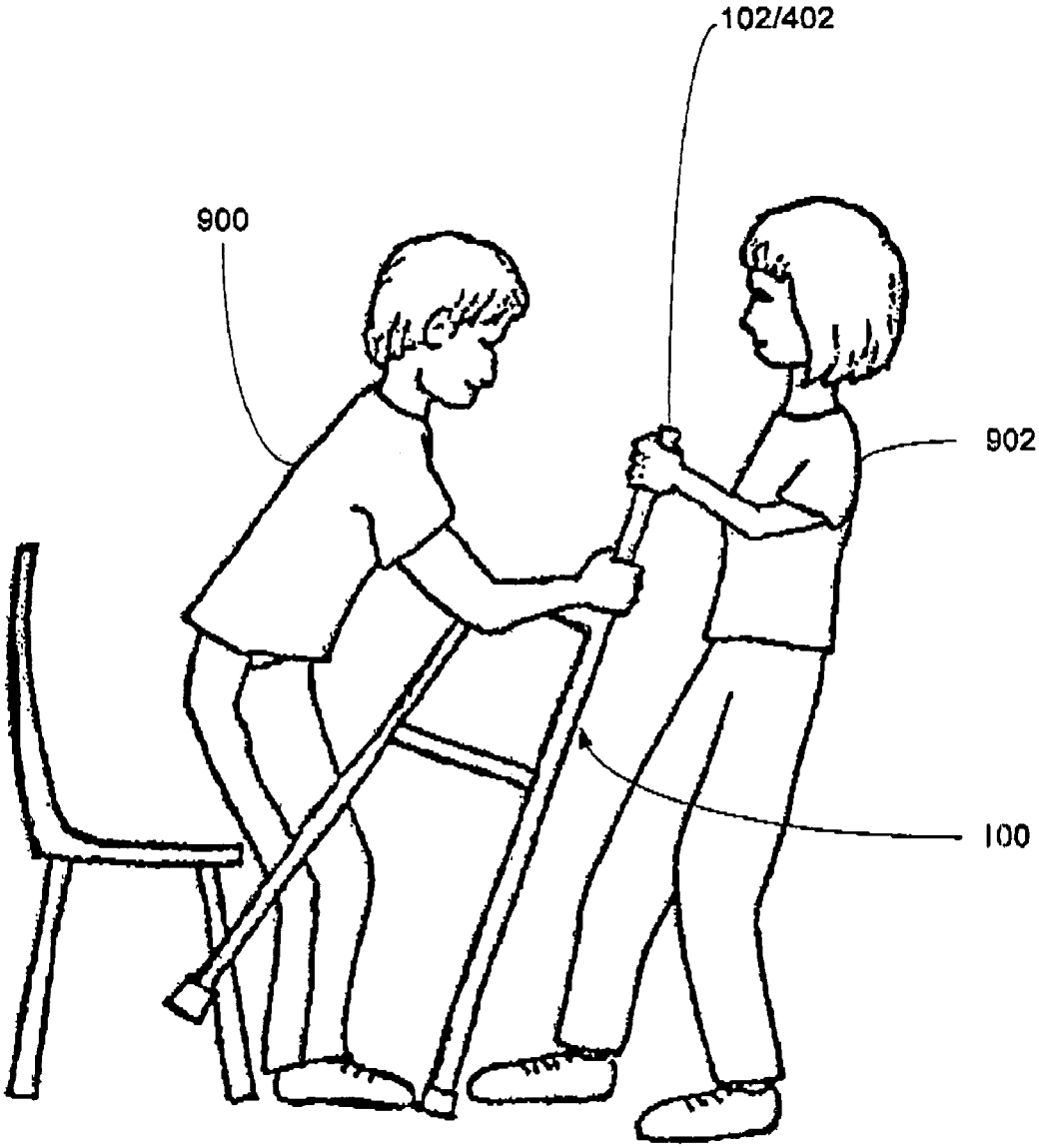
FIG. 10 demonstrates a view of an embodiment in accordance with the present invention in use.

In use, as shown in FIGS. 9 and 10, the lifting arm 402 may be used to assist a seated person 900 to stand. (Note that the use of lifting arm 402 in this example is exemplary only and that the other embodiments of lifting arms may be used in similar fashion.) As stated, the seated person 900 may be an elderly person, a person recovering from an illness or surgical procedure, or, in general, a person who has some mobility when standing (and may be able to use a walker) but has trouble standing from a seated position. The process of helping the seated person 900 to a standing position may begin by a helper 902 positioning the walker 100 with the lifting arm 402 in front of the seated person 900. The helper 902 may then extend the lifting arm 402 to an extended position if the lifting arm 402 is in a non-extended position. (Note that in some embodiments the lifting arm 402 may be permanently fixed in an extended position so that this step need not be performed.) The seated person 900 then may grip some point of the walker 100, such as the top support 108, the top of the rear legs 106, the top of the front legs 104, the cross support 112, or, preferably in some embodiments, the lower part of the lifting arms 402. The helper 902 then may grip the upper part of the lifting arm 402, and, taking advantage of the mechanical advantage (i.e., the leverage) that the lifting arm 402 provides, the helper 902 may pulls backwards, as shown in FIG. 10.

As the helper 902 pulls backward, the walker 100 generally will pivot at a point where the front legs 104 touch the ground. The shoes 107 of the front legs 104 may prevent sliding from occurring at this pivot point given the downward pressure associated with the pulling action and the tackiness of the shoes 107. The shoes 107 further may be arcuate in shape or have rounded edges so that the shoes 107 pivot more efficiently.

Figure 11:
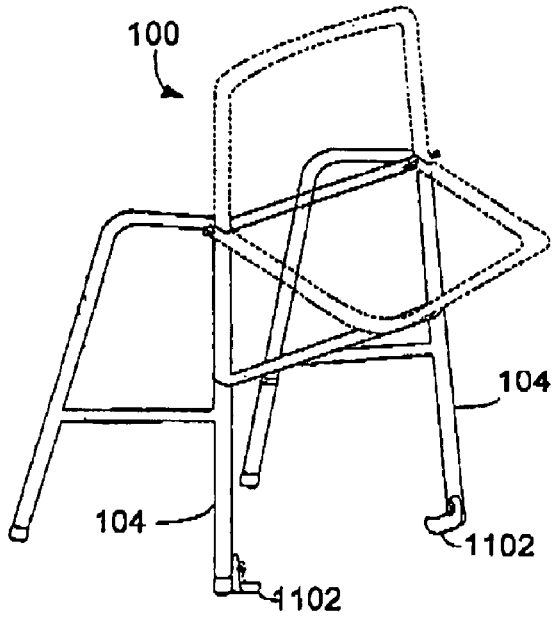
FIG. 11 demonstrates an embodiment of a footpad that may be used in certain embodiments of the present invention.
Figure 12:
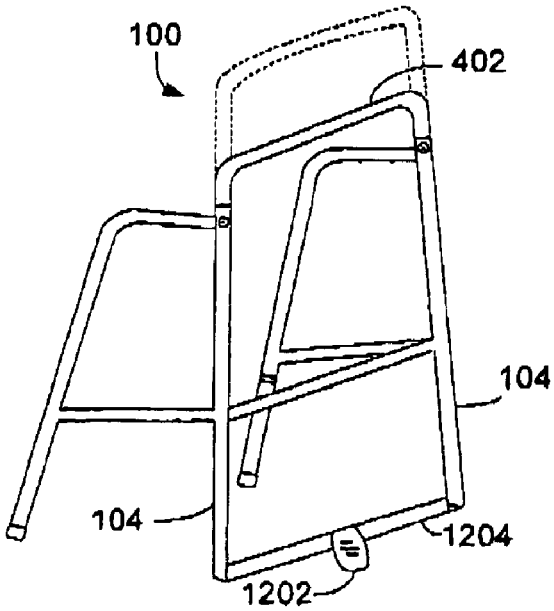
FIG. 12 demonstrates an embodiment of a footpad that may be used in certain embodiments of the present invention.

In alternative embodiments, a footpad may be placed at the bottom of one of the front legs 104. As shown in FIG. 11, the footpad 1102 may provide a surface area that may be depressed by either the foot of the helper 902 or the seated person 900 when the helper 902 pulls backward to assist the seated person. The footpad 1102 may be attached to the walker 100 per methods known in the art and may be located just above the shoe 107 of one or both of the front legs 104. The footpad 1102 may allow the helper 902 to provide additional downward force to ensure that the front legs 104 do not slide while the helper 902 pulls backward to assist the seated person 900 to stand. In some embodiments, the footpad 1102 may be attached to the walker 100 by a hinged connector (not shown). This may allow the footpad 1102 to be in a "down" position (in which the footpad 1102 may be substantially parallel to the ground) when the footpad 1102 is being used, and stored in an "up" position (in which the footpad 1102 may be substantially perpendicular to the ground) when the footpad 1102 is not being used. In alternative embodiments, a central footpad 1202 may be used, as demonstrated in FIG. 12. The central footpad 1202 may be attached to a footpad support 1204 that attaches to the bottom of each of the front legs 104.

As the helper 902 pulls backward, the seated person 900 continues to hold on to the walker 100 or lifting arm 402, whatever the case may be. The pulling force of the helper 902 is magnified by the leverage associated with the lifting arm 402 and this force is transferred to the seated person 900. Thusly the seated person 900 is pulled to a standing position. The leverage provided by the lifting arm 402 allows a small amount of pulling force from the helper 902 to provide a significant amount of pulling force to assist the seated person 900 to stand. In some embodiments, as little as 25 lbs. of pulling force may assist a 200 lb. person to stand from a seated position. Further, the helper 902 is pulling in a manner that is ergonomically safe and, thus, unlikely to cause injury to the helper 902. This is because the lifting arm 402 allows the helper 902 to pull while standing in an upright position with a straight back. In addition, the stability of the standing process is enhanced by the walker 100, thus reducing the risk of falls. The reverse of this procedure may be performed to allow a standing person to attain a seated position in a controlled and safe manner.

It should be apparent that the foregoing relates only to the preferred embodiments of the present invention and that numerous changes and modifications may be made herein without departing from the spirit and scope of the invention as defined by the following claims and the equivalents thereof.

I claim:

1. A walker device for assisting a seated person to stand, comprising:

a walker comprising a pair of interconnected front legs, a pair of back legs, each front leg connected to a respective back leg by a top support, each top support including a walker handle; and a first lifting arm and a second lifting arm attached to approximate ends of the pair of front legs of the walker respectively and extending at least 12 inches in an approximate vertical direction from the walker, the first lifting arm comprising a first gripping handle positioned at its approximate distal end, and the second lifting arm comprising a second gripping handle positioned at its approximate distal end, wherein the first lifting arm and the second lifting arm are moveable independent of the front legs;

wherein each lifting arm is configured to receive one hand of a seated person seated approximately between the pair of back legs at a first position and one hand of a helper at a second position approximately above the first position and sufficiently separated from the first position to produce leverage so that the walker pivots about the front and lifts the back legs when each lifting arm is pulled in a direction away from the seated person by the helper the lifting arm moves in a direction towards the helper to assist the seated person to a standing position.

2. The walker device of claim 1, further comprising a footpad attached to the bottom of one of the front legs.

3. The walker device of claim 1, wherein each lifting arm is moveable by extending telescopically from one of the front legs.

4. The walker device of claim 1, wherein each lifting arm is adjustable between two or more positions of extension.

5. The walker device of claim 4, wherein the two or more positions of extension include an extended position wherein each lifting arm is fully extended above one of the front legs.

6. The walker device of claim 4, wherein the two or more positions of extension include a non-extended position where the majority of the length of each lifting arm is contained inside one of the front legs.

7. The walker device of claim 4, further comprising openings in each lifting arm that engage a pin connected to the front legs;

wherein each opening corresponds to one of the two or more positions of extension; and wherein each lifting arm slides telescopically between the two or more positions of extension and, at each of the positions of extension, the corresponding opening is engaged by the pin.

8. The walker device of claim 7, further comprising a guide channel in each lifting arm that maintains alignment between the openings and the pin when each lifting arm is being slid between the two or more positions of extension.

9. The walker device of claim 1, wherein the lifting arms comprise a horizontal connector that connects each lifting arm at their approximate distal ends.

10. The walker device of claim 9, wherein the first gripping handle and the second gripping handle being connected to form a single gripping handle.

11. The walker device of claim 9, wherein the lifting arms each are adjustable between two or more positions of extension.

12. The walker device of claim 11, wherein the two or more positions of extension include an extended position wherein the lifting arms each are fully extended above the front legs.

13. The walker device of claim 12, wherein the two or more positions of extension include a non-extended position where the majority of the length of each lifting arm is substantially contained inside of the front legs.

14. The walker device of claim 11, further comprising openings in each lifting arm that engage a pin connected to each of the front legs;

wherein each opening corresponds to one of the two or more positions of extension; and wherein the lifting arms each slide telescopically between the two or more positions of extension and, at each of the positions of extension, the corresponding opening of each lifting arm is engaged by one of the pins.

15. The walker device of claim 14, further comprising an actuator that when activated disengages the pin of each front leg from the respective openings.

16. The walker device of claim 15, further comprising a cross support interconnecting the two front legs, wherein the actuator is located on the cross support.

17. The walker device of claim 1, wherein each first and second gripping handle comprises a gripping means.

18. The walker device of claim 1, wherein each first and second gripping handle at least partially comprises at least one of foam or rubber.

19. The walker device of claim 1, wherein the walker pivots at a point where distal portions of the two front legs contact with a ground surface.

20. The walker device of claim 1, wherein the first lifting arm is attached to one of the front legs and the second lifting arm is attached to the other front leg.

* * * * *

UNITED STATES PATENT AND TRADEMARK OFFICE

CERTIFICATE OF CORRECTION

PATENT NO. : 7,363,931 B2
APPLICATION NO. : 11/201737
DATED : April 29, 2008
INVENTOR(S) : Craig Weaver It is certified that error appears in the above-identified patent and that said Letters Patent is hereby corrected as shown below:

In Claim 1, at Column 10, line 9, after "by the helper" insert -- and --.

Signed and Sealed this

Twenty-ninth Day of July, 2008

JON W. DUDAS
*Director of the United States Patent and Trademark Office*